US012655836B2

(12) United States Patent
Wu et al.

(10) Patent No.: US 12,655,836 B2
(45) Date of Patent: Jun. 16, 2026

(54) U-SHAPED E-CIGARETTE PUMP HAVING A PERISTALTIC DRIVE AND TRANSMISSION ASSEMBLY

(71) Applicant: SHENZHEN SMOORE TECHNOLOGY LIMITED, Guangdong (CN)

(72) Inventors: Cong Wu, Shenzhen (CN); Dongyang Li, Shenzhen (CN); Xiaowen Wang, Shenzhen (CN); Fu Ke, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 7 days.

(21) Appl. No.: 18/415,894

(22) Filed: Jan. 18, 2024

(65) Prior Publication Data

US 2024/0183351 A1 Jun. 6, 2024

Related U.S. Application Data

(63) Continuation of application No. PCT/CN2022/107053, filed on Jul. 21, 2022.

(30) Foreign Application Priority Data

Jul. 22, 2021 (CN) ..... 202110833307.X

(51) Int. Cl.
*F04B 43/12* (2006.01)
*A24F 40/48* (2020.01)

(52) U.S. Cl.
CPC ..... *F04B 43/1253* (2013.01); *A24F 40/48* (2020.01)

(58) Field of Classification Search
CPC ..... F04B 43/1253; A24F 40/48
See application file for complete search history.

(56) References Cited

U.S. PATENT DOCUMENTS 5,460,493 A 10/1995 Deniega et al.
7,118,203 B2 * 10/2006 Davis ..... F04B 43/1292 347/85

(Continued)

FOREIGN PATENT DOCUMENTS

CN 102022308 A 4/2011
CN 102338070 A 2/2012

(Continued)

OTHER PUBLICATIONS

English Machine Translation of CN-103122848-A (Year: 2013).*

(Continued)

*Primary Examiner* — Nathan C Zollinger
(74) *Attorney, Agent, or Firm* — Leydig, Voit & Mayer, Ltd.

(57) ABSTRACT

A U-shaped e-cigarette peristaltic pump includes: a carrier; a drive assembly; a transmission assembly; and a peristaltic assembly. The drive assembly is arranged on the carrier. The peristaltic assembly and the drive assembly are arranged side by side on a same side of the carrier. A first accommodating space is provided between the drive assembly and the carrier. A second accommodating space is provided between the peristaltic assembly and the carrier. The transmission assembly is respectively in the first accommodating space and the second accommodating space. The drive assembly is connected to the peristaltic assembly through the transmission assembly.

16 Claims, 8 Drawing Sheets

(56) References Cited

U.S. PATENT DOCUMENTS

| | | | | |
|---|---|---|---|---|
| 8,511,318 | B2 * | 8/2013 | Hon | H02J 7/00 131/194 |
| 10,451,055 | B2 * | 10/2019 | Quintarelli | F04B 43/1253 |
| 2005/0047946 | A1 * | 3/2005 | Davis | F04B 43/1284 417/477.11 |
| 2010/0278667 | A1 * | 11/2010 | Gault | F04B 43/1269 417/477.6 |
| 2013/0177463 | A1 | 7/2013 | Cheng et al. | |
| 2018/0249763 | A1 | 9/2018 | Schmidt et al. | |
| 2020/0196678 | A1 * | 6/2020 | Chen | F04B 49/065 |

FOREIGN PATENT DOCUMENTS

| | | | | |
|---|---|---|---|---|
| CN | 202851317 | U | | 4/2013 |
| CN | 103122848 | A | * | 5/2013 |
| CN | 105697343 | A | | 6/2016 |
| CN | 207583601 | U | | 7/2018 |
| CN | 109349689 | A | | 2/2019 |
| CN | 209228989 | U | | 8/2019 |
| CN | 209331186 | U | | 9/2019 |
| CN | 110761981 | A | | 2/2020 |
| CN | 211648420 | U | | 10/2020 |
| CN | 212106216 | U | | 12/2020 |
| CN | 112943587 | A | | 6/2021 |
| CN | 113494444 | A | | 10/2021 |
| CN | 215949785 | U | | 3/2022 |
| JP | 0532782 | U | | 4/1993 |
| WO | 2013053982 | A1 | | 4/2013 |

OTHER PUBLICATIONS

European Patent Office, Search Report in European Patent Application No. 22179596.6 (Dec. 2, 2022).

Patent Cooperation Treaty, International Search Report and Written Opinion, International Application No. PCT/CN2022/107053 (Oct. 11, 2022).

Chinese Patent Office, Office Action in Chinese Patent Application No. 202110833307.X (Dec. 20, 2024).

* cited by examiner

U-SHAPED E-CIGARETTE PUMP HAVING A PERISTALTIC DRIVE AND TRANSMISSION ASSEMBLY

CROSS-REFERENCE TO PRIOR APPLICATION

This application is a continuation of International Patent Application No. PCT/CN2022/107053, filed on Jul. 21, 2022, which claims priority to Chinese Patent Application No. 202110833307.X, filed on Jul. 22, 2021. The entire disclosure of both applications is hereby incorporated by reference herein.

FIELD

The present invention relates to the technical field of e-cigarettes, and specifically, to a U-shaped e-cigarette peristaltic pump.

BACKGROUND

E-cigarettes are products that are relatively popular in recent years, which can simulate conventional cigarettes, namely, after being inhaled by a user, corresponding vapor can be generated. A principle of the e-cigarettes is mainly to heat refined e-liquid to vaporize the heated liquid e-liquid, so that an effect of smoking can be achieved after the vaporized e-liquid is inhaled by the user.

According to the content disclosed by patent "CN201822169593.0", as shown in FIG. 1, FIG. 1 is a schematic structural diagram of a peristaltic pump in the related art. The structure of the peristaltic pump in this patent includes a motor outer cover 260, a motor 210, a deceleration apparatus 220, a pump head 230, and a hose 240, where the motor 210 and the deceleration apparatus 220 are in the motor outer cover 260, the pump head 230 is connected to the deceleration apparatus 220, and the hose 240 is squeezed by rotation of the pump head 230, to add or clear e-liquid. As can be found through this patent, the motor outer cover 260 is externally attached to the motor 210 and the deceleration apparatus 220, and the motor outer cover 260 also occupies a certain space, so that the entire volume of the product is increased. In addition, the deceleration apparatus 220 adopts a conventional decelerator, the conventional decelerator is formed by a deceleration box and a plurality of gear sets, and a size of the decelerator is decided by arrangement of the plurality of gear sets in the deceleration box. However, an arrangement manner of the plurality of gear sets in the decelerator cannot be further optimized due to limitation of the structure of the deceleration box. Therefore, for a case that speeds of the plurality of gear sets need to be changed, the volume of the deceleration box is necessarily increased, the volume of the entire decelerator is further increased, and the volume of a final product may be also increased, which not only increases manufacturing costs, but is also inconvenient for use and carrying.

SUMMARY

In an embodiment, the present invention provides a U-shaped e-cigarette peristaltic pump, comprising: a carrier; a drive assembly; a transmission assembly; and a peristaltic assembly, wherein the drive assembly is arranged on the carrier, wherein the peristaltic assembly and the drive assembly are arranged side by side on a same side of the carrier, wherein a first accommodating space is provided between the drive assembly and the carrier, wherein a second accommodating space is provided between the peristaltic assembly and the carrier, wherein the transmission assembly is respectively in the first accommodating space and the second accommodating space, and wherein the drive assembly is connected to the peristaltic assembly through the transmission assembly.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
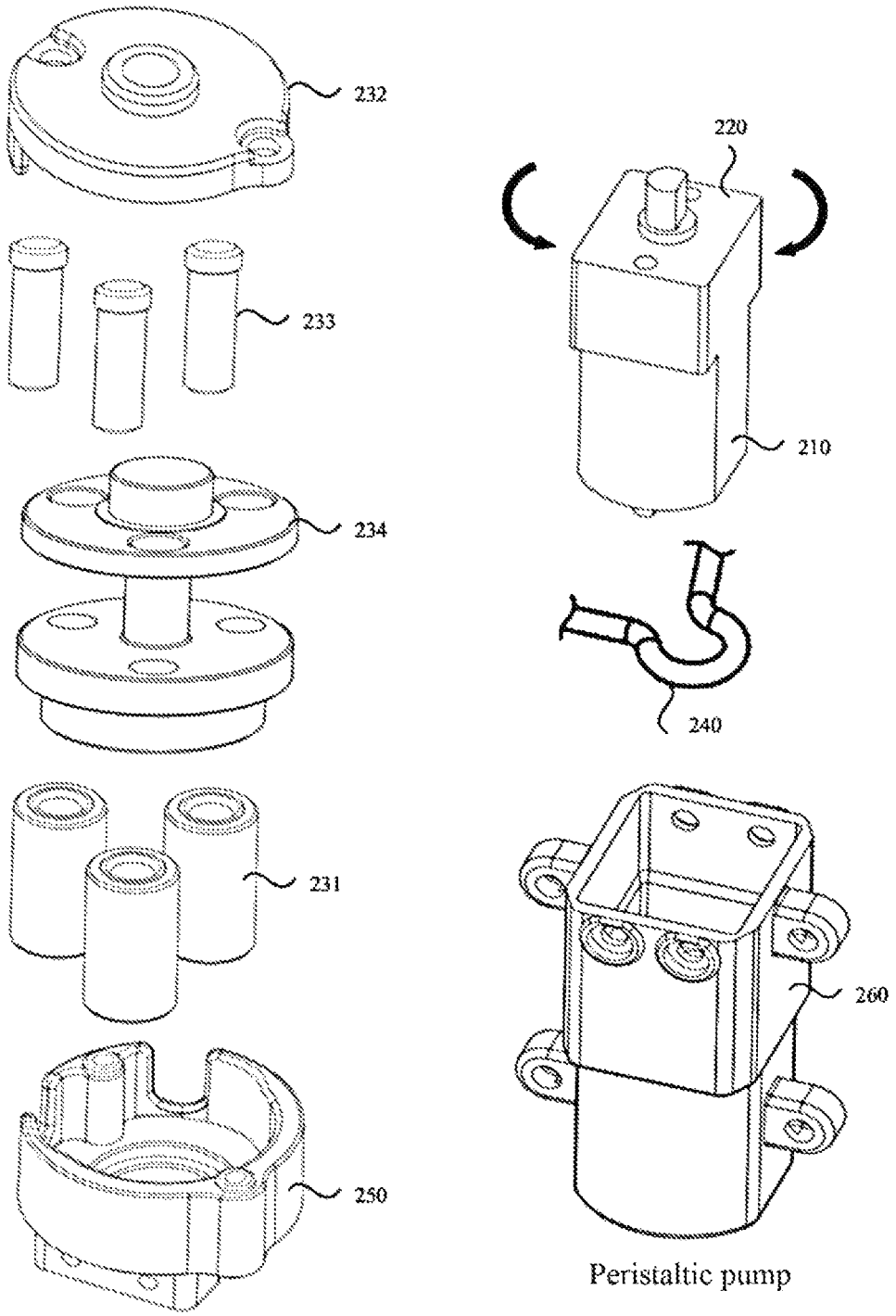
FIG. 1 is a schematic structural diagram of a peristaltic pump in the related art.

In an embodiment, the present invention provides a U-shaped e-cigarette peristaltic pump.

In an embodiment, the present invention provides a U-shaped e-cigarette peristaltic pump that includes a carrier, a drive assembly, a transmission assembly, and a peristaltic assembly. The drive assembly is arranged on the carrier, the peristaltic assembly and the drive assembly are arranged side by side on the same side of the carrier, a first accommodating space is provided between the drive assembly and the carrier, a second accommodating space is provided between the peristaltic assembly and the carrier, the transmission assembly is respectively in the first accommodating space and the second accommodating space, and the drive assembly is connected to the peristaltic assembly through the transmission assembly.

According to an implementation of the present invention, the transmission assembly includes a plurality of transmission shafts and a plurality of transmission gears, the plurality of transmission shafts are respectively in the first accommodating space and the second accommodating space, the plurality of transmission gears are rotatably connected to the plurality of transmission shafts, and the plurality of transmission gears are sequentially engaged with each other.

According to an implementation of the present invention, the drive assembly includes a drive support member and a drive member, the drive support member is arranged on the carrier, the drive support member and the carrier form the first accommodating space, and the drive member is arranged on the drive support member.

According to an implementation of the present invention, the drive assembly further includes a drive output member, the drive output member is arranged on an output end of the drive member, and the drive output member is connected to the transmission assembly.

According to an implementation of the present invention, the carrier is provided with an accommodating hole, and some regions of the drive output member are in the accommodating hole.

According to an implementation of the present invention, the peristaltic assembly includes a peristaltic support member, a peristaltic power member, and a convey member, the peristaltic support member is arranged on the carrier, the peristaltic power member is arranged in the peristaltic support member, the peristaltic power member is connected to the transmission assembly, and the convey member abuts against the peristaltic power member.

According to an implementation of the present invention, the peristaltic support member includes a peristaltic holder and a peristaltic cover, the peristaltic holder is arranged on the carrier and forms the second accommodating space with the carrier, the peristaltic cover covers the peristaltic holder, the peristaltic cover and the peristaltic holder form an accommodating cavity, and the peristaltic power member and the convey member are both in the accommodating cavity.

According to an implementation of the present invention, the peristaltic power member includes a peristaltic shaft, a peristaltic frame, and a peristaltic wheel, the peristaltic shaft runs through the peristaltic support member, the peristaltic shaft is respectively connected to the peristaltic frame and the transmission assembly, and the peristaltic wheel is rotatably connected to the peristaltic frame.

According to an implementation of the present invention, an edge of the peristaltic frame is provided with a first fixing hole, and the peristaltic wheel is rotatably arranged in the first fixing hole through a connecting shaft.

According to an implementation of the present invention, the peristaltic frame is internally provided with a second fixing hole, and the peristaltic wheel is rotatably arranged in the second fixing hole through a connecting shaft.

Beneficial effects of the present invention are as follows: according to the engagement arrangement of the carrier, the drive assembly, the transmission assembly, and the peristaltic assembly, the transmission assembly is respectively in the first accommodating space and the second accommodating space, to further connect the drive assembly to the peristaltic assembly, and the transmission assembly, the drive assembly, and the peristaltic assembly are all arranged on the carrier, and are entirely in a shape of "U". Therefore, not only the first accommodating space and the second accommodating space are appropriately utilized, but also a conventional deceleration outer box is reduced. In addition, the arrangement of the transmission assembly is more compact, an effect of volume reduction is achieved, and the volume of a final product is also reduced, which is convenient for carrying and use.

DESCRIPTION OF REFERENCE NUMERALS

1—Carrier; 11—Accommodating hole; 12—Through hole;

2—Drive assembly; 21—Drive support member; 211—Drive support pillar; 212—Drive support plate; 22—Drive member; 23—Drive output member;

3—Transmission assembly; 31—Transmission shaft; 32—Transmission gear;

4—Peristaltic assembly; 41—Peristaltic support member; 411—Peristaltic holder; 412—Peristaltic cover; 413—Accommodating cavity; 414—Peristaltic support pillar; 42—Peristaltic power member; 421—Peristaltic shaft; 422—Peristaltic frame; 4221—First fixing hole; 4222—Second fixing hole; 423—Peristaltic wheel; 424—Connecting shaft; 43—Convey member;

5—First accommodating space; and

6—Second accommodating space.

A plurality of implementations of the present invention will be disclosed in the following drawings. For clear description, many details in practice will be described in the following descriptions. However, it should be understood that such details in practice should not be used to limit the present invention. That is, the details in practice are not necessary in some implementations of the present invention. In addition, to simplify the drawings, some well-known and usual structures and components are shown in the drawings in a simple schematic manner.

Further, descriptions including "first", "second", and the like in the present invention are only used for a description purpose, do not specifically mean an order or a sequence, are not used for limiting the present invention, but are merely used for distinguishing between components or operations described by using the same technical term, and cannot be understood as indicating or implying relative importance thereof or implying a quantity of the indicated technical features. Therefore, features defining "first" and "second" can explicitly or implicitly include at least one of the features. In addition, technical solutions between the embodiments may be combined with each other, provided that the combination of the technical solutions can be implemented by a person of ordinary skill in the art. When the combined technical solutions conflict with each other or cannot be implemented, it should be considered that such a combination of the technical solutions does not exist or is not within the protection scope of the present invention.

Embodiment 1

Figure 2:
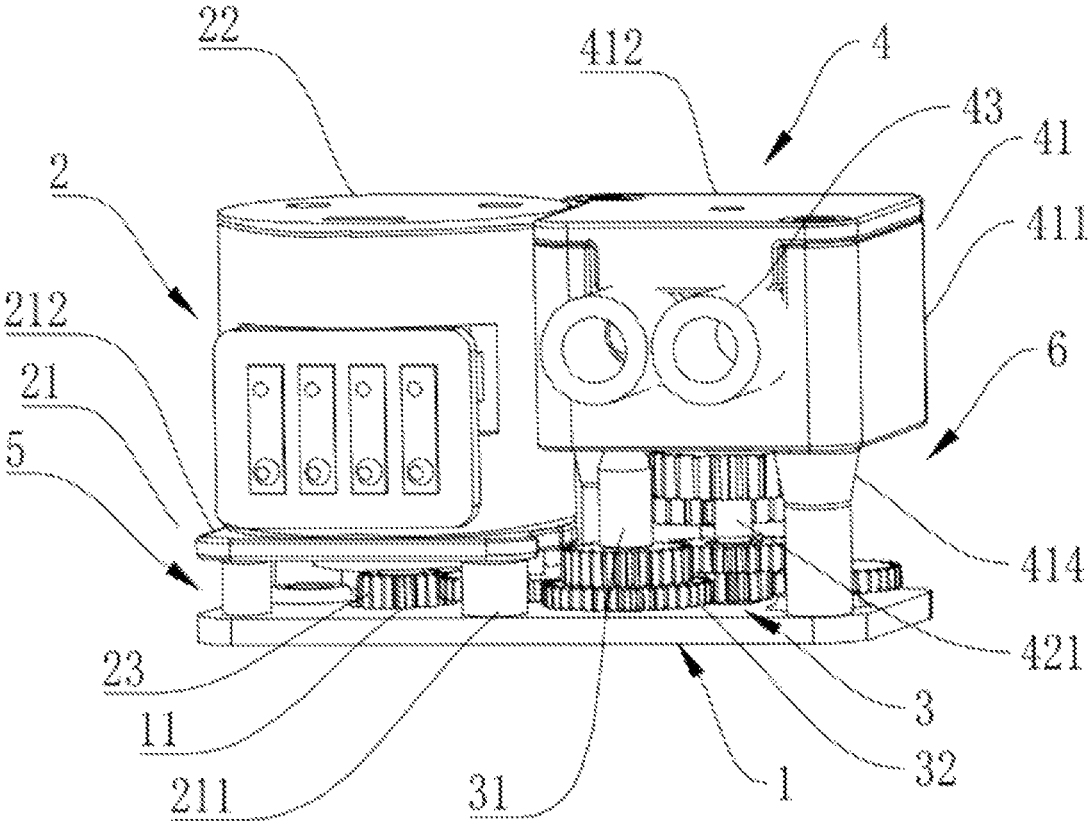
FIG. 2 is a three-dimensional structural diagram of a U-shaped e-cigarette peristaltic pump according to Embodiment 1.
Figure 3:
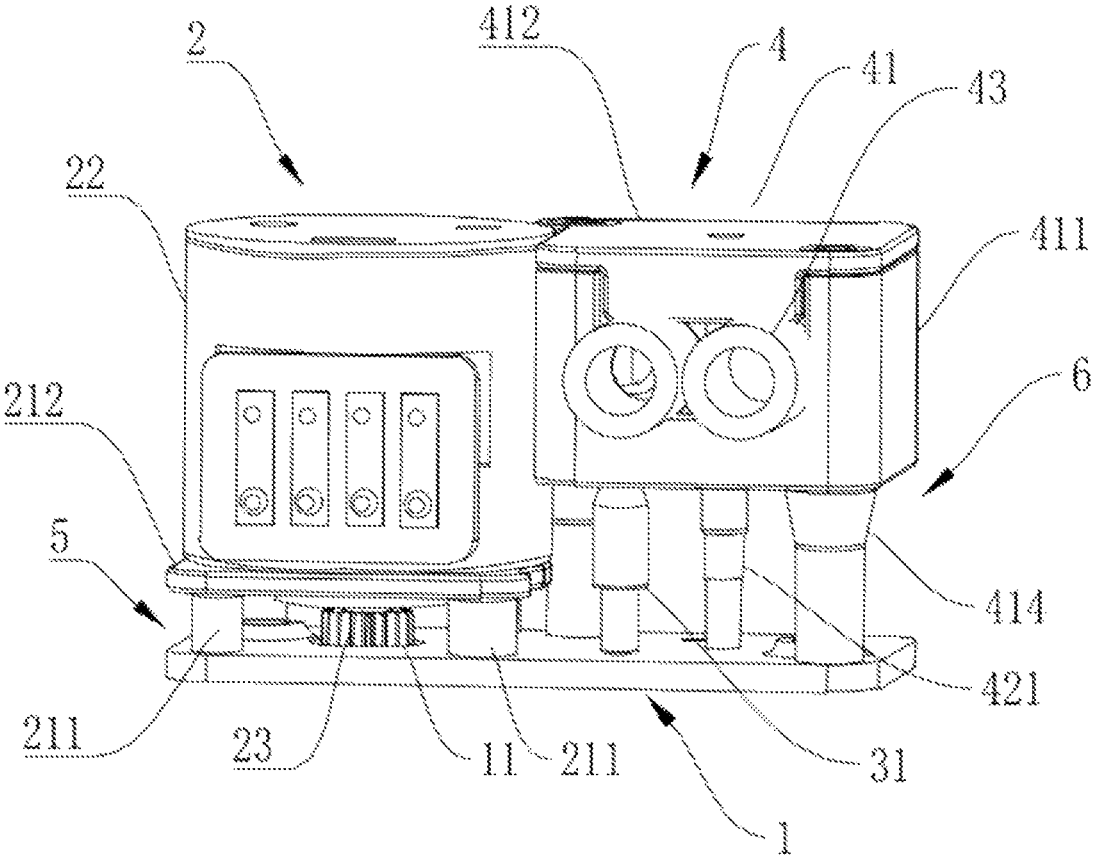
FIG. 3 is another three-dimensional structural diagram of a U-shaped e-cigarette peristaltic pump according to Embodiment 1.

As shown in FIG. 2 and FIG. 3, FIG. 2 is a three-dimensional structural diagram of a U-shaped e-cigarette peristaltic pump according to Embodiment 1; and FIG. 3 is another three-dimensional structural diagram of a U-shaped e-cigarette peristaltic pump according to Embodiment 1. In this embodiment, the U-shaped e-cigarette peristaltic pump includes a carrier 1, a drive assembly 2, a transmission assembly 3, and a peristaltic assembly 4. The drive assembly 2, the transmission assembly 3, and the peristaltic assembly 4 are all arranged on the carrier 1, and the drive assembly 2 and the transmission assembly 3 are arranged side by side on the same side of the carrier 1. The drive assembly 2 is connected to the peristaltic assembly 4 through the transmission assembly 3, and the drive assembly 2, the transmission assembly 3, and the peristaltic assembly 4 are integrated through the carrier 1, which facilitates combination and maintenance, further facilitates adjustment of an overall layout, and facilitates to reduce the volume that is occupied.

Figure 4:
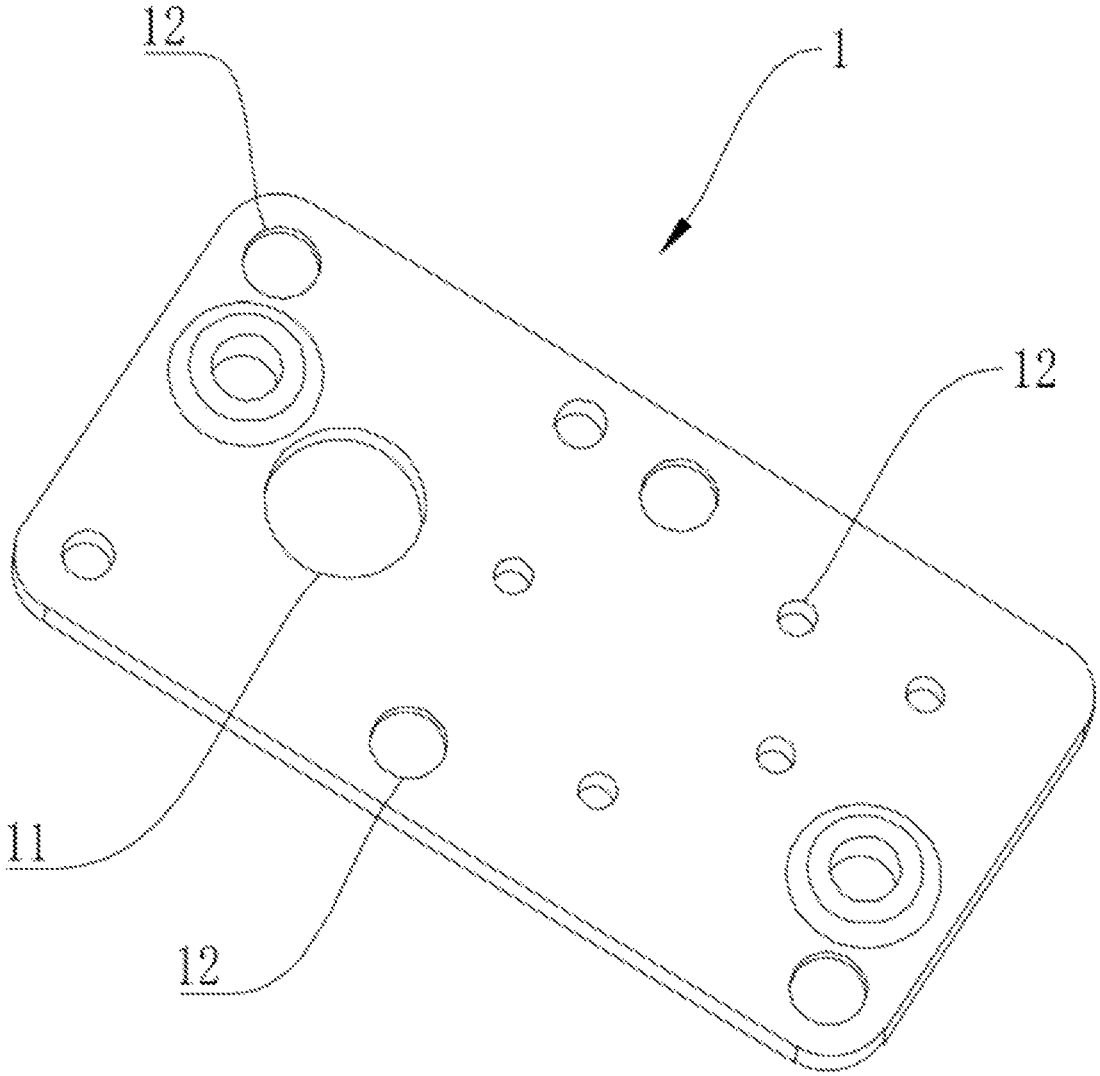
FIG. 4 is a three-dimensional structural diagram of a carrier according to Embodiment 1.

Further referring to FIG. 4, FIG. 4 is a three-dimensional structural diagram of the carrier 1 according to Embodiment 1. The carrier 1 is provided with an accommodating hole 11, and some regions of an output end of the drive assembly 2 are in the accommodating hole 11, to reduce the volume occupied by the output end of the drive assembly 2. During a specific application, when the drive assembly 2, the transmission assembly 3, and the peristaltic assembly 4 are connected to the carrier 1, the carrier 1 is provided with corresponding through holes 12. In this way, the thickness of the carrier 1 can be appropriately utilized, to further achieve an effect of volume reduction.

Referring to FIG. 2 and FIG. 3 again, the drive assembly 2 includes a drive support member 21 and a drive member 22. The drive support member 21 is arranged on the carrier 1, the drive support member 21 includes a plurality of drive support pillars 211 and a drive support plate 212, the plurality of drive support pillars 211 are arranged in the through holes 12, the drive support plate 212 is connected to the plurality of drive support pillars 211, the drive member 22 is arranged on the drive support plate 212, and an output end of the drive member 22 runs through the drive support plate 212. Specifically, there are four drive support pillars 211, and the four drive support pillars 211 are spaced apart below the drive support plate 212, to improve the support stability of the drive support pillars 211 to the drive support plate 212. Certainly, the quantity of the drive support pillars 211 is not merely limited to four, and may alternatively be two. In another embodiment, a first accommodating space 5 is provided between the drive support plate 212 and the carrier 1, a part of the transmission assembly 3 is in the first accommodating space 5, and the drive member 22 is connected to the transmission assembly 3. Preferably, the drive assembly 2 further includes a drive output member 23, the drive output member 23 is connected to the output end of the drive member 22, and the drive output member 23 is connected to the transmission assembly 3. The drive member 22 operates when energized and drives the drive output member 23 to rotate, and the drive output member 23 then drives the transmission assembly 3 to rotate. In this embodiment, some regions of the drive output member 23 are in the accommodating hole 11, and the drive output member 23 is rotatable in the accommodating hole 11. A part of the drive output member 23 that is not in the accommodating hole 11 is connected to the transmission assembly 3, so that the thickness of the carrier 1 is fully utilized, a space occupied by the drive output member 23 is reduced, and an effect of volume reduction is achieved. Specifically, the drive member 22 is a stepping motor and has an advantage of a small volume when compared with a direct current motor or another motor. The drive output member 23 is a gear.

Figure 5:
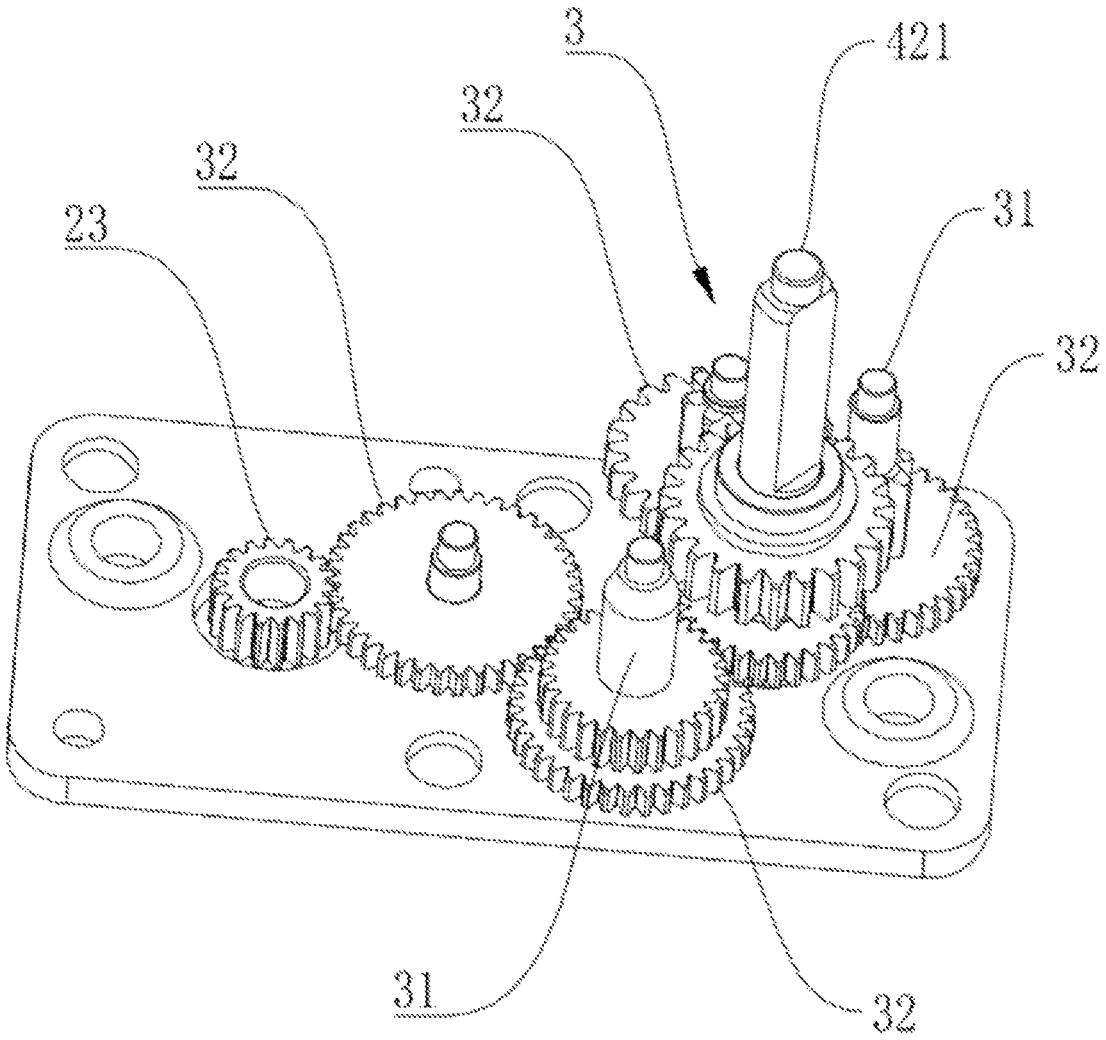
FIG. 5 is a schematic three-dimensional structural diagram of a transmission assembly according to Embodiment 1.

Further referring to FIG. 5, FIG. 5 is a schematic three-dimensional structural diagram of the transmission assembly 3 according to Embodiment 1. The transmission assembly 3 includes a plurality of transmission shafts 31 and a plurality of transmission gears 32. The transmission shafts 31 are arranged in the first accommodating space 5, and some transmission shafts 31 are respectively connected to the drive support plate 212 and the carrier 1. In addition, some transmission shafts 31 are arranged between the peristaltic assembly 4 and the carrier 1, and the transmission shafts 31 are also respectively connected to the peristaltic assembly 4 and the carrier 1. The plurality of transmission gears 32 are sequentially rotatably arranged on the plurality of transmission shafts 31, the drive output member 23 is connected to one of the transmission gears 32, and the peristaltic assembly 4 is also connected to one of the transmission gears 32. The drive output member 23 drives one transmission gear 32 to rotate, the transmission gears 32 mutually drive each other, and power is finally transferred to the peristaltic assembly 4. During a specific application, junctions of the transmission shafts 31 and the carrier 1 are also provided with through holes 12 accordingly, which facilitates assembly and reduces the volume. In another embodiment, there are four transmission shafts 31, and there are six transmission gears 32, where four transmission gears 32 are respectively rotatably arranged on the four transmission shafts 31, and two transmission gears 32 are arranged on a power input end of the peristaltic assembly 4. One transmission gear 32 serves as intermediate transmission, so that the transmission gear is rotatably arranged on the power input end of the peristaltic assembly 4, and the other transmission gear 32 serves as power, so that the transmission gear is fixedly connected to the power input end of the peristaltic assembly 4, to drive the power input end of the peristaltic assembly 4 to move. In a limited space, the plurality of transmission gears 32 are arranged in a circuitously upward manner, to appropriately utilize the space. Therefore, not only a required deceleration effect can be achieved, but also the volume can be reduced.

Figure 6:
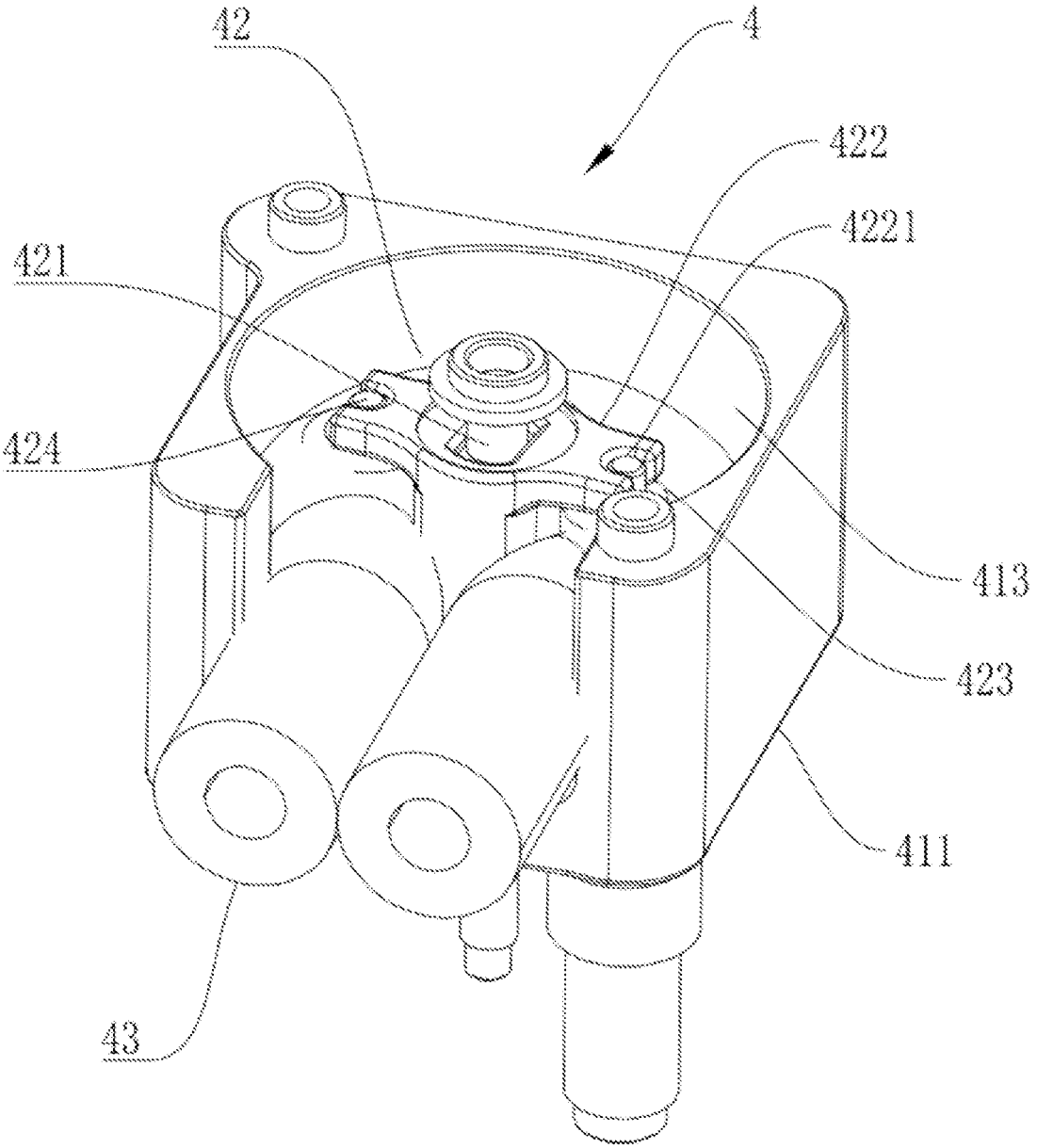
FIG. 6 is a three-dimensional structural diagram of a peristaltic assembly according to Embodiment 1.
Figure 7:
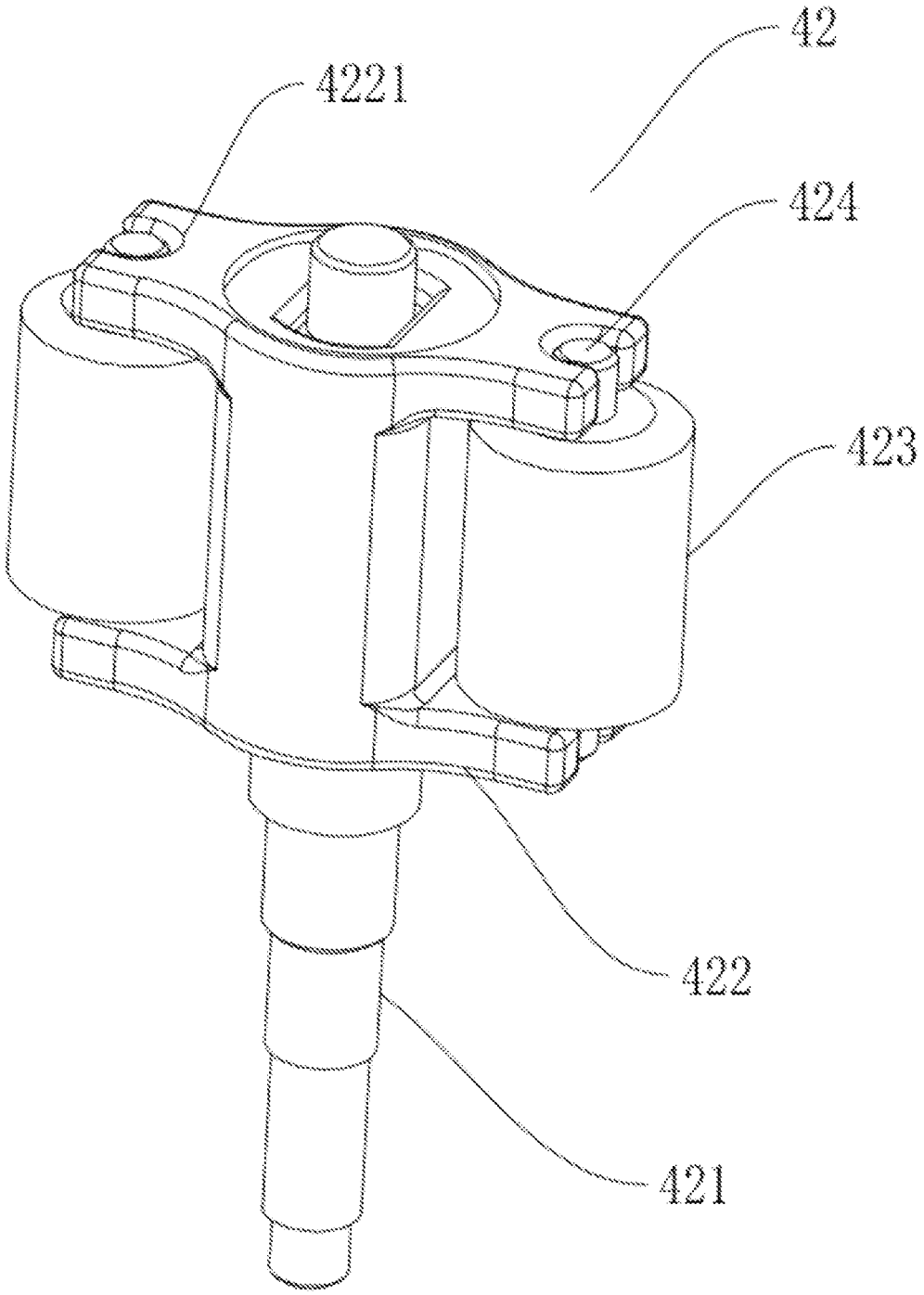
FIG. 7 is a three-dimensional structural diagram of a peristaltic power member according to Embodiment 1.

Further referring to FIG. 6 and FIG. 7, FIG. 6 is a three-dimensional structural diagram of the peristaltic assembly 4 according to Embodiment 1; and FIG. 7 is a three-dimensional structural diagram of a peristaltic power member 42 according to Embodiment 1. The peristaltic assembly 4 includes a peristaltic support member 41, the peristaltic power member 42, and a convey member 43. The peristaltic support member 41 is arranged on the carrier 1, the peristaltic power member 42 is arranged in the peristaltic support member 41, the convey member 43 is arranged in the peristaltic support member 41, and the peristaltic power member 42 squeezes the convey member 43 during operation. Referring to FIG. 1 and FIG. 2 again, the peristaltic support member 41 includes a peristaltic holder 411 and a peristaltic cover 412, the peristaltic holder 411 is arranged in a through hole 12 on the carrier 1, and the peristaltic cover 412 covers the peristaltic holder 411. Meanwhile, an accommodating cavity 413 is formed between the peristaltic cover 412 and the peristaltic holder 411, the peristaltic power member 42 is in the accommodating cavity 413, the convey member 43 is also in the accommodating cavity 413, and an input end and an output end of the convey member 43 protrude out of the accommodating cavity 413 to be connected to other components. In this embodiment, the peristaltic holder 411 and the carrier 1 are connected through a peristaltic support pillar 414, and the peristaltic support pillar 414 and the peristaltic holder 411 may be separated structures or may be an integral structure. In this embodiment, the peristaltic holder 411 and the peristaltic support pillar 414 adopt an integral structure, which facilitates early-stage processing, reduces assembly processes, improves the efficiency, and increases the stability. A second accommodating space 6 is provided, some transmission shafts 31 and transmission gears 32 are in the second accommodating space 6. That is, the plurality of transmission shafts 31 and the plurality of transmission gears 32 are respectively in the first accommodating hole 11, the second accommodating space 6, and a position therebetween. The drive assembly 2, the transmission assembly 3, and the peristaltic assembly 4 are in a U-shaped connection, and the transmission shafts 31 and the transmission gears 32 are appropriately arranged by appropriately utilizing the first accommodating space 5 and the second accommodating space 6, thereby implementing power transferring and achieving an effect or reducing the volume that is occupied.

Referring to FIG. 6, the peristaltic power member 42 includes a peristaltic shaft 421, a peristaltic frame 422, and a peristaltic wheel 423. The peristaltic shaft 421 runs through the peristaltic holder 411 and is connected to the transmission gear 32, the peristaltic frame 422 is connected to the peristaltic shaft 421, the peristaltic wheel 423 is rotatably arranged on the peristaltic frame 422, and the peristaltic wheel 423 abuts against the convey member 43. In this embodiment, the peristaltic shaft 421 is the power input end of the peristaltic assembly 4, the transmission gear 32 drives the peristaltic shaft 421 to rotate, and the peristaltic shaft 421 drives the peristaltic frame 422 and the peristaltic wheel 423 to rotate together. In a rotation process, the peristaltic wheel 423 squeezes the convey member 43, and the method of squeezing the convey member 43 through the peristaltic wheel 423 has smaller friction and higher efficiency and causes less damage to the convey member 43 when compared with a conventional cam squeezing method. Therefore, a service life of the convey member 43 is improved, and later maintenance costs are reduced. An edge of the peristaltic frame 422 is provided with a first fixing hole 4221. The first fixing hole 4221 is at the edge of the peristaltic frame 422, so that the first fixing hole 4221 is a semicircular hole, which facilitates mounting, dismounting, and maintenance of the peristaltic wheel 423. During a specific application, the peristaltic wheel 423 is clamped in the first fixing hole 4221 through a connecting shaft 424. The peristaltic frame 422 is entirely elongated, there are two peristaltic wheels 423, the two peristaltic wheels 423 are respectively arranged on two ends of the peristaltic frame 422, and each of the two ends of the peristaltic frame 422 is also provided with a corresponding first fixing hole 4221 clamped with the connecting shaft 424. It should be further noted that the quantity of the peristaltic wheels 423 is not limited to two, and may alternatively be one, three, or more, which is selected for use according to requirements during a specific application.

Specifically, the convey member 43 is a tube formed by a soft material such as a silicon tube or a rubber tube, and certainly may be another soft tube.

During operation, the drive member 22 drives the drive output member 23 to rotate, the drive output member 23 drives the transmission gear 32 to rotate, the plurality of transmission gears 32 sequentially drive each other for transmission and transfer power to the peristaltic shaft 421, the peristaltic shaft 421 drives the peristaltic frame 422 to rotate, and the peristaltic wheels 423 on the peristaltic frame 422 rotate together. The two peristaltic wheels 423 squeezes the convey member 43 in a rotation process, a negative pressure is generated in the convey member 43, e-liquid of an e-cigarette is absorbed in the convey member 43, and the e-liquid is finally conveyed to a vaporization room for vaporization.

Embodiment 2

Figure 8:
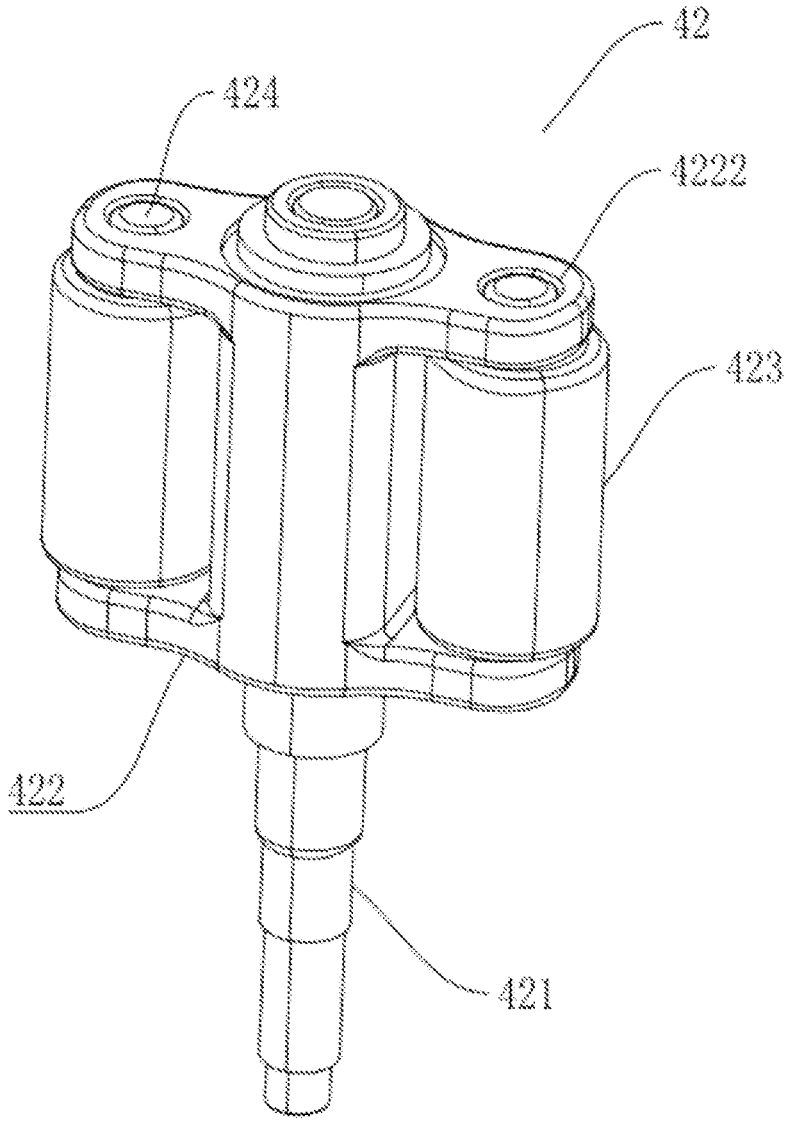
FIG. 8 is another three-dimensional structural diagram of a peristaltic power member according to Embodiment 2.

Further referring to FIG. 8, FIG. 8 is another three-dimensional structural diagram of the peristaltic power member 42 according to Embodiment 2. The structure in this embodiment and the structure of Embodiment 1 are basically the same, and a difference lies in that, the peristaltic frame 422 is provided with a second fixing hole 4222, and the second fixing hole 4222 is in the peristaltic frame 422, so that a section of the second fixing hole 4222 is a circle, thereby effectively preventing the connecting shaft 424 from falling off in an assembly or use process, and improving the overall stability.

Based on the above, according to the engagement arrangement of the carrier, the drive assembly, the transmission assembly, and the peristaltic assembly, the transmission assembly is respectively in the first accommodating space and the second accommodating space, to further connect the drive assembly to the peristaltic assembly. The transmission assembly, the drive assembly, and the peristaltic assembly are all arranged on the carrier, and are entirely in a shape of "U". Therefore, not only the first accommodating space and the second accommodating space are appropriately utilized, but also a conventional deceleration outer box is reduced. In addition, the arrangement of the transmission assembly is more compact, an effect of volume reduction is achieved, and the volume of a final product is also reduced, which is convenient for carrying and use.

The foregoing descriptions are merely implementations of the present invention and are not intended to limit the present invention. For a person skilled in the art, various modifications and changes can be made to the present invention. Any modification, equivalent replacement, or improvement made within the spirit and principle of the present invention shall fall within the scope of the claims of the present invention.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A U-shaped e-cigarette peristaltic pump, comprising:

a carrier;

a drive assembly;

a transmission assembly; and a peristaltic assembly, wherein the drive assembly is arranged on the carrier, wherein the peristaltic assembly and the drive assembly are arranged side by side on a same side of the carrier, wherein a first accommodating space is provided between the drive assembly and the carrier, wherein a second accommodating space is provided between the peristaltic assembly and the carrier, wherein the transmission assembly is respectively in the first accommodating space and the second accommodating space, wherein the drive assembly is connected to the peristaltic assembly through the transmission assembly, and wherein the carrier includes an accommodating hole and a plurality of through holes, portions of the drive assembly being arranged in the accommodating hole.

2. The U-shaped e-cigarette peristaltic pump of claim 1, wherein the transmission assembly comprises a plurality of transmission shafts and a plurality of transmission gears, wherein the plurality of transmission shafts are respectively in the first accommodating space and the second accommodating space, wherein the plurality of transmission gears are rotatably connected to the plurality of transmission shafts, and wherein the plurality of transmission gears are sequentially engaged with each other.

3. The U-shaped e-cigarette peristaltic pump of claim 1, wherein the drive assembly comprises a drive support member and a drive member, wherein the drive support member is arranged on the carrier, wherein the drive support member and the carrier form the first accommodating space, and wherein the drive member is arranged on the drive support member.

4. The U-shaped e-cigarette peristaltic pump of claim 3, wherein the drive assembly further comprises a drive output member, wherein the drive output member is arranged on an output end of the drive member, and wherein the drive output member is connected to the transmission assembly.

5. The U-shaped e-cigarette peristaltic pump of claim 4, wherein some regions of the drive output member are in the accommodating hole.

6. The U-shaped e-cigarette peristaltic pump of claim 1, wherein the peristaltic assembly comprises a peristaltic support member, a peristaltic power member, and a convey member, wherein the peristaltic support member is arranged on the carrier, wherein the peristaltic power member is arranged in the peristaltic support member, wherein the peristaltic power member is connected to the transmission assembly, and wherein the convey member abuts against the peristaltic power member.

7. The U-shaped e-cigarette peristaltic pump of claim 6, wherein the peristaltic support member comprises a peristaltic holder and a peristaltic cover, wherein the peristaltic holder is arranged on the carrier and forms the second accommodating space with the carrier, wherein the peristaltic cover covers the peristaltic holder, wherein the peristaltic cover and the peristaltic holder form an accommodating cavity, and wherein the peristaltic power member and the convey member are both in the accommodating cavity.

8. The U-shaped e-cigarette peristaltic pump of claim 6, wherein the peristaltic power member comprises a peristaltic shaft, a peristaltic frame, and a peristaltic wheel, wherein the peristaltic shaft runs through the peristaltic support member, wherein the peristaltic shaft is respectively connected to the peristaltic frame and the transmission assembly, and wherein the peristaltic wheel is rotatably connected to the peristaltic frame.

9. The U-shaped e-cigarette peristaltic pump of claim 8, wherein an edge of the peristaltic frame is provided with a first fixing hole, and wherein the peristaltic wheel is rotatably arranged in the first fixing hole through a connecting shaft.

10. The U-shaped e-cigarette peristaltic pump of claim 8, wherein the peristaltic frame is internally provided with a second fixing hole, and wherein the peristaltic wheel is rotatably arranged in the second fixing hole through a connecting shaft.

11. The U-shaped e-cigarette peristaltic pump of claim 1, wherein the plurality of through holes are configured to receive a plurality of rotating shafts and support pillars, and wherein the accommodating hole has a different diameter than each through hole of the plurality of through holes.

12. The U-shaped e-cigarette peristaltic pump of claim 11, wherein a first through hole of the plurality of through holes is configured to rotatably receive a transmission shaft, wherein a second through hole of the plurality of through holes is configured to rotatably receive a peristaltic drive shaft, and wherein a third through hole of the plurality of through holes is configured to receive a peristaltic support pillar configured to support the peristaltic assembly.

13. The U-shaped e-cigarette peristaltic pump of claim 12, wherein a fourth and fifth through hole of the plurality of through holes are each configured to receive a drive support pillar configured to support the drive assembly.

14. The U-shaped e-cigarette peristaltic pump of claim 3, wherein the peristaltic support pillar is longer than the drive support pillars such that the peristaltic assembly is offset farther relative to the carrier than the drive assembly, the offset of the peristaltic assembly relative to the carrier being configured to accommodate the transmission assembly.

15. The U-shaped e-cigarette peristaltic pump of claim 1, wherein the carrier comprises a monolithic plate, and wherein the accommodating hole and the plurality of through holes are arranged on a single planar surface of the carrier.

16. The U-shaped e-cigarette peristaltic pump of claim 14, wherein the carrier has a uniform thickness at the single planar surface, and wherein the accommodating hole and the plurality of through holes each have a uniform depth through the carrier.

* * * * *